US006795029B2

(12) United States Patent
Baker

(10) Patent No.: US 6,795,029 B2
(45) Date of Patent: Sep. 21, 2004

(54) DEVICES FOR REMOTE COMMUNICATION

(75) Inventor: Jess Baker, Stockbridge, GA (US)

(73) Assignee: BellSouth Intellectual Property Corp., Wilmington, DE (US)

( * ) Notice: Subject to any disclaimer, the term of this patent is extended or adjusted under 35 U.S.C. 154(b) by 0 days.

(21) Appl. No.: 10/305,113

(22) Filed: Nov. 27, 2002

(65) Prior Publication Data

US 2004/0100411 A1 May 27, 2004

(51) Int. Cl.[7] ..... H01Q 1/24
(52) U.S. Cl. ..... 343/702; 343/830; 343/880; 361/683
(58) Field of Search ..... 343/702, 878, 343/880, 892, 830, 900; 361/683

(56) References Cited

U.S. PATENT DOCUMENTS 5,619,395 A * 4/1997 McBride ..... 361/683
5,867,131 A * 2/1999 Camp et al. ..... 343/797
6,222,501 B1 * 4/2001 Yajima et al. ..... 343/878
6,650,532 B2 * 11/2003 Shin ..... 361/683

* cited by examiner

*Primary Examiner*—Shih-Chao Chen
(74) *Attorney, Agent, or Firm*—Withers & Key, LLC

(57) ABSTRACT

A device for promoting the remote communication of a portable computer is described having a base that is attachable to the computer, an antenna that projects outward from the base, and a cable that connects the base to the computer. The device is made adjustable to fit a variety of different types of portable computers and be secured tightly on to them.

22 Claims, 3 Drawing Sheets

DEVICES FOR REMOTE COMMUNICATION

BACKGROUND

1. Field of the Invention

The present invention relates generally to devices for remote communication. More particularly, the present invention relates to antenna systems for enabling remote communication for portable electronic devices.

2. Background of the Invention

The development and proliferation of increasingly powerful computers in smaller and more portable packages have boosted the demand and use for such computers. Such popular portable computers include, for example, laptop computers, notebook computers, personal data assistants ("PDAs"), and the like. The portability of these computers means that a user is no longer confined to the limits of, for example, a table on which the computer rests, and further enables the user to carry and use such computers virtually anywhere. Thus, certain computers, such as, for example, laptop computers, are used in multiple environments, such as work and home. Such multi-locale use of the same computer has increased the efficiency and work production of users who can work anywhere and can carry a single computer with them.

Similar rapid advances in the use of the Internet and remote work capabilities have further enabled persons to use the Internet or work servers from virtually anywhere there is a telephone line, thus, further increasing efficiency and productivity. Although telephone jacks and higher speed cable lines are becoming ubiquitous, there is a growing feeling that even such devices used for electronic communication are still too restrictive. For example, a user who desires to work remotely from home must physically connect a computer, such as a laptop, directly to a telephone line or cable in order for the computer to access the user's remote work server. This connection at home from the laptop computer to the telephone jack or cable limits the physical work area of the user. For example, if the only available telephone jack is located in a den of the home, then the user is confined to the den for the time that is needed to be in contact with the remote work server. The user is thus "imprisoned" within the cord's length perimeter of the telephone jack or connector for his speed cable located inside the den.

Some devices have been developed that enable the user to work on a laptop or other portable computer, be connected to a far away host through an Internet line, and not be confined to a certain physical environment immediately around a telephone jack or other physical cable connection box. Such devices are usually antennas that are attached to a remote controller card that is in a card slot of the computer. These antennas tend to be either a single wire or an antenna that sits on a table or other flat surface and is connected to the computer through a wire. These examples of remote communication devices have decreased the physical space restrictions that conventional landline wire connectors had required. For example, a user may have a remote base attached to a telephone jack in the den, but can use the laptop anywhere in the house, and still work remotely with an employer's server, as long as the antenna attached to the laptop is in communication with the remote base in the den.

SUMMARY OF THE INVENTION

The present invention is an antenna-containing device that quickly, easily, securely, and reversibly attaches an antenna to a portable computer to enable the computer to have remote communication ability. The device includes adjusting mechanisms that allow it to securely attach the device to different types of portable computers. This attachment allows the antenna to be hoisted generally above the computer to enable better remote reception. Also, the device is securely attached to the computer in such a manner that the device does not have to be carried separately when the computer is moved with the device still connected to the computer. Furthermore, the device is designed such that it is generally universal, can fit many different types of portable computers, and is easily adjustable.

An exemplary embodiment of the present invention is a device for enabling remote communication with a portable computer. The device includes a base that is securely attachable to a portion of a portable computer, an antenna on the base, and a cable extending from the base to a port of the computer, wherein the antenna is in electrical communication with the cable.

Another exemplary embodiment of the present invention is a device for device for portable computer to enable remote communication. The device includes a U-shaped base that is slideable onto a visual display of a portable computer, an adjusting arm that adjusts to fit the base onto the visual display, an antenna on the base, and a cable extending from the base to a port ort of the computer, wherein the antenna is in electrical communication with the cable.

Yet another exemplary embodiment of the present invention is a device that includes a portion of a portable computer, and means for remote communication securely attachable to the portion of the portable computer, wherein the means for remote communication is attached such that any movement of the attached portion of the computer results in a substantially same movement in the means for remote communication.

DETAILED DESCRIPTION OF PREFERRED EMBODIMENTS

The present invention encompasses devices and methods of enabling remote communication of a computer without having cumbersome wires or loose antennas hanging from the laptop computer. The present invention also promotes better remote communication by placing an antenna highly and steadily on a computer without interfering with the structure of the computer or obstructing the screen. The present invention also facilitates transporting a portable computer having such exemplary embodiments of remote communication devices attached thereon such that such devices do not have to be handled separately because of a snug connection to the computer.

The exemplary embodiments shown and described in detail below use a conventional laptop computer as an example. However, this invention is not limited to use with laptop computers and may be used with other types of portable computers that could benefit from remote communication capability. Also, although the exemplary embodiments describe remote communication of a laptop computer to a remote receiver or base within a short physical distance from the laptop computer, such as, for example, in another room of the house or structure where the laptop is being used, this invention is not limited to such use, and may be used to give the laptop more powerful remote communication capability, such as with a far away receiver, for example, as commonly used in cellular telephones.

Figure 1:
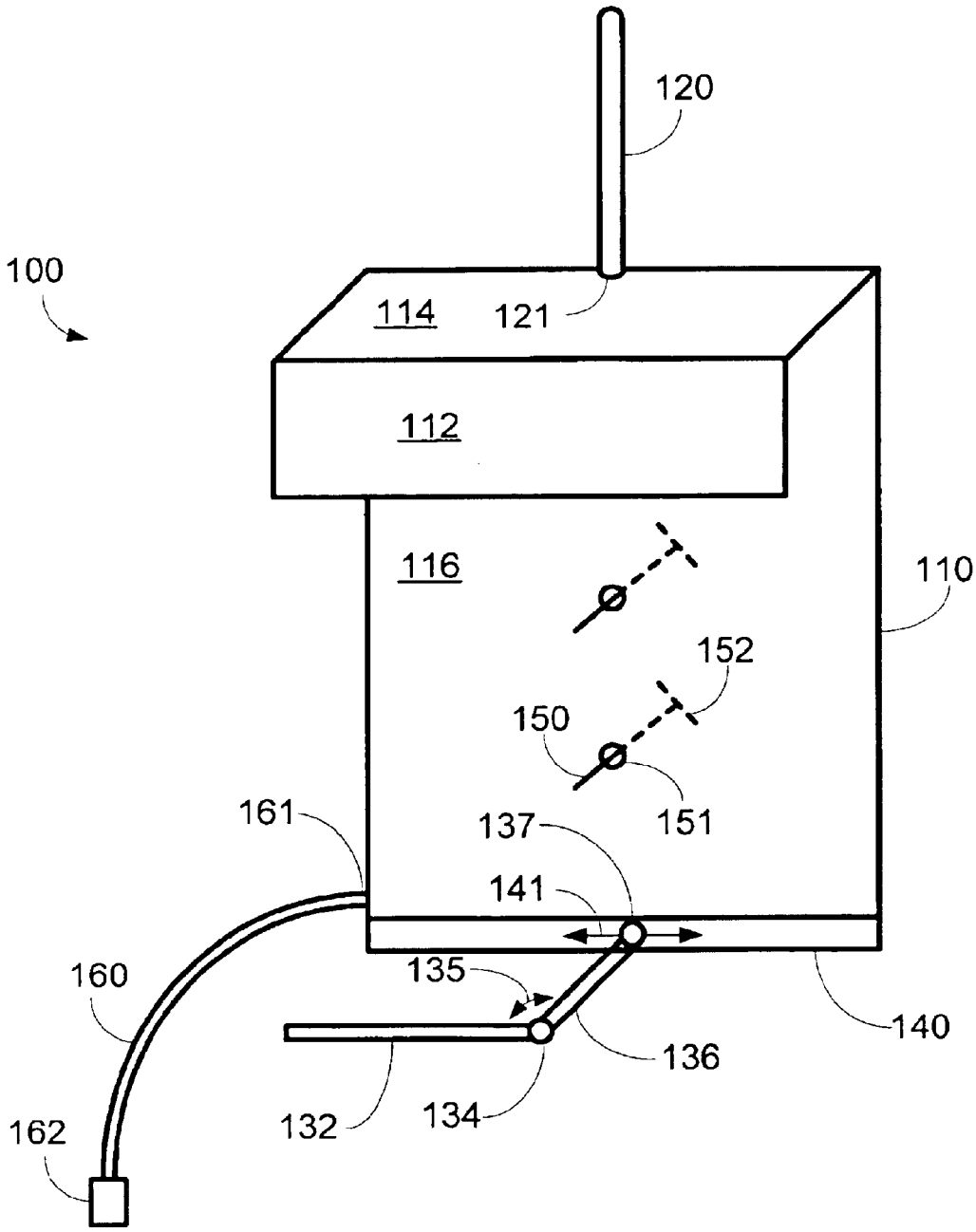
FIG. 1 shows an exemplary embodiment of a remote communication device according to an exemplary embodiment of the present invention.

As shown in FIG. 1, an exemplary embodiment of the present invention is a device 100 for remote communication from a laptop computer. The device 100 includes a base 110 that has multiple components attached thereto. Base 110 includes a U-shaped end comprising a generally planar back wall 116 and an end wall 114 which is perpendicular thereto. A front lip 112 is perpendicular to the end wall 114, and parallel with back wall 112. Front lip 112 and back wall 116 form the extensions of the U-shaped base 110 with end wall 114 position perpendicular with both. Base 110 may be constructed of any suitable material, such as, for example, plastic, metal, or combinations thereof. The present invention is not limited to plastic or metals and other materials are possible.

Connected to end wall 114 is an antenna 120 which projects outward from base 110. Antenna 120 is connected to end wall 114 injunction area 121. Although the junction area 121 is shown in the back central area of end wall 114 as shown in FIG. 1, antenna 120 may be placed anywhere on end wall 114. Other locations for placement of antenna 120 is also possible. Antenna 120 is constructed of metal or other materials suitable for use in antennas that promote remote communication between the attached laptop and a remote receiver.

Further attached to base 110 is an arm mechanism that includes a rotating arm piece 132 and a sliding arm piece 136. Rotating arm piece 132 is connected to sliding arm piece 136 through a rotating lock 134 that enables rotating arm piece 132 to rotate in direction of arc arrow 135, defining a plane that is perpendicular to sliding arm piece 136. In other words, the plane of rotation of rotating arm piece 132 is parallel to the plane of back wall 116. Sliding arm piece 136 slides along an end of base 110 by being connected to a lock 137 that slides along position slider 140 in the linear direction of arrow 141. The arm mechanism is universal such that it can be locked into multiple positions using the locks 134 and 137. This will enable the device 100 to slide onto a part of a computer from either the right or left side of the device 100 as shown in FIG. 1, and the arm mechanism would simply be adjusted to grip onto or rest on a side of the computer body and prevent further sliding in a given direction. Such a mechanism in operation will be shown and described below with respect to FIGS. 2 and 3.

Back wall 116 includes one or more adjustment screws 150 that penetrate back wall 116 in a perpendicular direction. Adjustment screws 150 rest securely in threaded screw accommodating areas 151 in back wall 116. Threaded accommodating areas 151 enable a snug fit between an adjustment screw 150 and back wall 116. Adjustment screw 150 may include a turning top 152 to enable ease in adjusting the position of adjustment screw 150 with respect to back wall 116 and to tighten or loosen the device 100 against a part of a computer. Although two adjustment screws 150 are shown in FIG. 1, any number is possible to enable a secure fit between base 110 and a computer, as will be described in more detail below.

Remote communication device 100 includes a cable 160 that is attached to base 110 at cable connection area 161. Cable 160 may be positioned anywhere on base 110 as long as it is in direct electrical communication with antenna 120. Alternatively, if base 110 is metallic, cable 160 does not have to extend directly to antenna 120 and is in sufficient electrical communication to antenna 120 through metallic base 110. At an end of cable 160 is an adapter 162 that is designed to mate with a conventional wireless card used on a laptop, thereby electrically connecting the laptop to the remote communication device 100.

Figure 2:
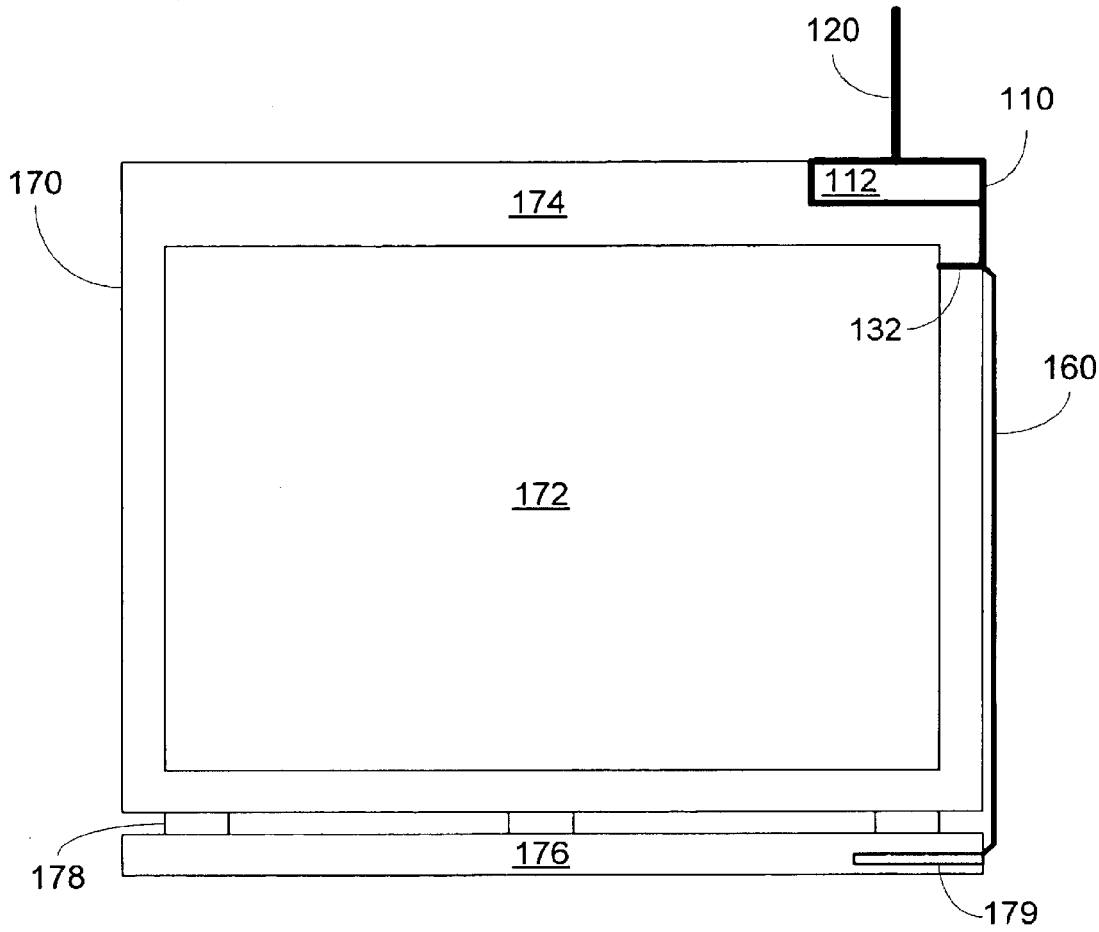
FIG. 2 shows a front view of a conventional laptop computer having attached thereon an exemplary embodiment of a remote communication device according to the present invention.
Figure 3B:
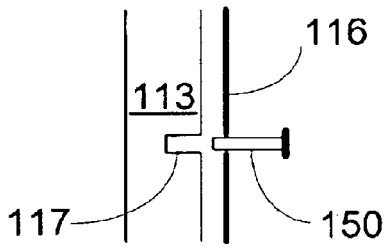
FIG. 3B shows a side view of an adjustment screw traversing through a wall and being accommodated by a screw retaining chamber of limited length.
Figure 3A:
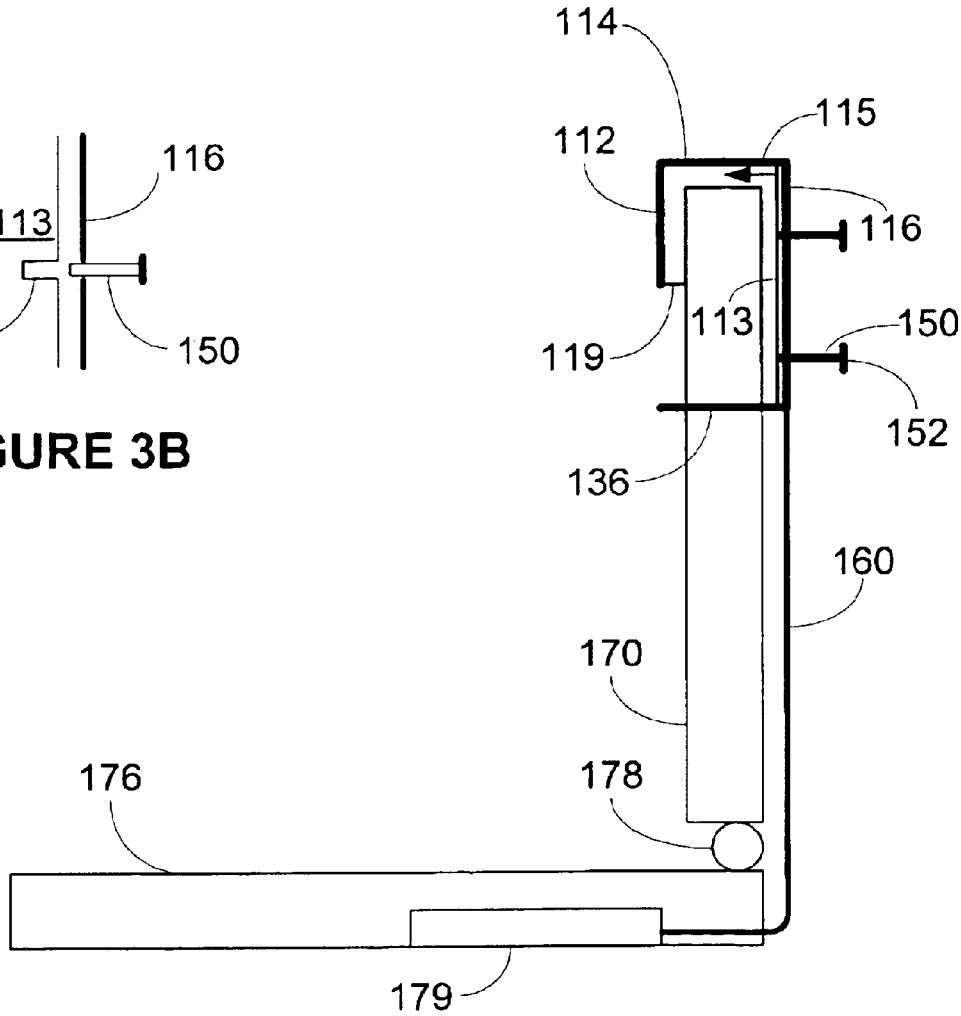
FIG. 3A shows a side view of a conventional laptop computer having attached thereon an exemplary embodiment of a remote communication device according to the present invention.

Remote communication device 100 is attachable to a laptop computer at a variety of different locations and is adjustable to fit snugly into such various locations without damaging the computer. For example, as shown in FIG. 2, base 110 is attached to a top right corner of a visual display 170 of a conventional laptop computer. Visual display 170 has a screen 172 and a frame 174 that surrounds screen 172. Base 110 is designed to attach to frame 174 and thereby minimally obstructing screen 174. Front lip 112 hangs over part of frame 174 and securely grips the front of the visual display 170 while the back wall 116 is laying against a back portion of the visual display 170. Rotating arm 132 is positioned in place over frame 174 to further promote a snug fit of the remote communication device 100 with visual display 170. Adjustment screws 150 located in the back side of the visual display, as shown in FIG. 3A, are used to more securely tighten the position of the remote communication device 100 with the visual display 170. Although base 110 is shown in an upper right corner of visual display 170 in the examples shown in FIGS. 2 and 3, remote communication device 100 may be placed in other places on visual display 170.

Visual display 170 is attached to base 176 of laptop through one or more rotating pins 178. Base 176 typically contains, for example, a central processing unit (CPU) of the computer, memory, hard drive, keyboard, various connections ports, and communication cards. A wireless communication card 179 is typically used to enable the laptop to communicate remotely. Base 110 of remote communication device 100 is in electronic communication with laptop base 176 via cable 160 using adapter 162 that mates with a wireless communication card 170.

To further promote a snug fit between base 110 and visual display 170, and as shown in FIG. 3A, a layer 119 of resilient material may be lined within the inner sides of the three walls 112, 114, and 116, particularly the concave portion of the U-shaped end of base 110. Such resilient material may be, for example, a polyurethane cushion, foam, sponge, soft fabric, or similar material that would not cause damage to screen 172 or frame 174, and would prevent the base from scratching or otherwise damaging visual display 170 when being slid thereon. Tips of the adjustment screws 150 may end at the resilient material 119 to prevent accidental damage to visual display 170 when the adjustment screws are tightened using turning tops 152. Optionally, ball bearings may be used at the end of the tips of the screws 150 to prevent damage to visual display 170. TEFLON or other similar material may be used for the adjustment screws 150 to prevent scratching and other potential damage. To further promote a snug fit between remote communication device 100 and visual display 170, sliding arm 136 rests against an end of visual display 170 when the base is slid thereon, as shown in FIG. 3A.

Optionally, a protective sheet 113 of substantially hard material may be positioned within the interior surface of back wall 116, separating the layer of resilient material 119 from the tips of the adjustment screw 150. The protective sheet may be constructed of metal, TEFLON, hardened plastic, or similar material that can withstand the turning pressures of the adjustment screw 150. In practice, when base 110 slides over visual display 170, the top end of the visual display is held within the cushions of resilient material 119. Adjustment screws 150 may then be tightened gently in the direction of arrow 115, which gently pushes the protective sheet 113 in the direction of arrow 115 and presses the adjacent sheet of resilient material 119 against a back side of visual display 170. Because any turning of the adjustment screws 150 in the direction of arrow 115 would result in a distribution of force across the entire surface area of protective sheet 113, there is less likelihood of damage to visual display 170 from adjustment of the screws 150.

As an additional precautionary step, the tips of adjustment screws 150 may be flattened to prevent penetration of the protective sheet 113 by such tips when adjustment screws 150 are turned in the direction of arrow 115. Optionally, the threading on adjustment screws 150 may be terminated at a given length so as to only allow such a preset length of the screw to penetrate through back wall 116, thereby limiting the distance which the protective sheet 116 may be pushed into the direction of arrow 115.

Other mechanisms to prevent damage to visual display 170 are possible. For example, as shown in FIG. 3B, adjustment screw 150 may only penetrate through back wall 116 a preset distance as determined by a screw retaining chamber 117 of limited length positioned on the opposite side of back wall 116. In the exemplary embodiment shown, screw retaining chamber 117 is a component of protective sheet 113, but other embodiments are possible where chamber 117 and protective sheet 113 are separate components. Using a retaining chamber 117 as shown would further ensure that adjustment screw 150 would not penetrate or otherwise damage visual display 170.

In FIGS. 2 and 3, base 110 was tightened onto visual display 170 at a top right portion thereon. However, by simply adjusting the sliding arm 136 to slide all the way to the left side of position slider 140 and locked therein, and rotating the rotating arm 132 such that it points to the right and locked therein, base 110 may be secured to visual display 170 from a top left hand portion. Such ease in adjustment and positioning of the remote communication device 100 onto a visual display 170 facilitates the attachment process and also minimizes the length of cable 160 that must extend from the base 110 to wireless communication card 179. Different laptops may have different configurations, including different locations for wireless communication card 179, thereby making such ease in adjustability of the remote communication device 100 particularly useful.

The exemplary configurations of a remote communication device 100, as shown in FIG. 1, and in combination with a laptop as shown in FIGS. 2 and 3 have a number of advantages over conventional wireless communication devices. For example, the flexible design of the exemplary embodiment shown in FIGS. 1–3 enables the remote communication device 100 to be attached to various locations on visual display 170. Because different computers have different sizes and shapes, the universal nature of the design of remote communication device 100 enables a user to use the same device 100 on multiple different laptop computers.

Further, by attaching device 100 directly onto visual display 170, antenna 120 is, by design, placed in a higher position than conventional wireless communication devices, thereby resulting in generally better reception and more trouble-free remote communication. Antenna 120 is extended out from visual display 170 into a space that is generally further away from the electronic architecture of computer base 176, which could interfere with proper reception. Conventional wires that hang loosely from wireless communication card 179 and act as antennas typically are in closer proximity to the computer base 176, and therefore likely suffer from greater electronic interference with proper reception than antenna 120 of the exemplary embodiments of the present invention.

Additionally, there is ease in transport of a laptop with remote communication device 100 attached thereto because of the intended snug fit between base 110 and visual display 170. Remote communication device 100 is designed to fit snugly onto a visual display 170 in such a manner as to become an extension of the visual display 170, and be supported fully by the visual display 170. Transport of laptops with conventional wireless communication devices attached thereon is typically cumbersome and annoying because of the dangling wires that extend out from the wireless communication card 179 or the additional loose equipment necessary for non-attached antennas that hang off of wireless card slot 179.

In describing representative embodiments of the invention, the specification may have presented the method and/or process of the invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the invention should not be limited to the performance of their steps in the order written, and one skilled in the art can readily appreciate that the sequences may be varied and still remain within the spirit and scope of the invention.

The foregoing disclosure of the embodiments of the invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

What is claimed is:

1. A device for enabling remote communication with a portable computer, the device comprising:

a base that is securely attachable to a portion of a portable computer, base including one adjustable arm for providing security of attachment of the base to the portable computer, a first portion of the adjustable arm being slideably moveable on the base and a second portion of the adjustable arm being pivotally connected to the first portion for adjusting an attached position of the base to the portable computer;

an antenna on the base; and a cable extending from the base to a port of the computer, wherein the antenna is in electrical communication with the cable.

2. The device of claim 1, wherein the portable computer is a laptop computer having a separate visual display and CPU base connectable by at least one rotating pin.

3. The device of claim 2, wherein the base has a U shape and slides on the visual display of the laptop.

4. The device of claim 3, wherein the base further has at least one adjustment screw to secure the base to the visual display.

5. The device of claim 1, wherein the adjustment arm is configured so that when the base is attached to the portable computer, the first portion rests against a side of the visual display and the second portion locates in front of the visual display to secure the position of the base with respect to the visual display.

6. The device of claim 1, wherein the antenna is generally parallel with the visual display, and projects away from the visual display when the base is attached thereon.

7. The device of claim 1, wherein the base is securely attached to the computer in such a manner that a movement of the computer results in a substantially identical movement of the base.

8. The device of claim 5, wherein the second portion defines a plane that is perpendicular to the first portion.

9. The device of claim 1, wherein the base includes a slider and the adjustable arm are connected with the slider of the base and is slidable along the slider.

10. A device for portable computer to enable remote communication, the device comprising:

a U-shaped base that is attachable onto a visual display of a portable computer;

an adjusting arm that adjusts to fit the base onto the visual display, wherein a first portion of the adjustable arm is slideably moveable on the base and a second portion of the adjustable arm is pivotally connected to the first portion for adjusting an attached position of the base to the portable computer;

an antenna on the base; and a cable extending from the base to a port of the computer, wherein the antenna is in electrical communication with the cable.

11. The device of claim 10, wherein the portable computer is a laptop computer having a separate visual display and CPU base connectable by at least one rotating pin.

12. The device of claim 11, wherein a concave portion of the U shape includes a layer of resilient material.

13. The device of claim 12, wherein the base further has at least one adjustment screw to secure the base to the visual display.

14. The device of claim 12, wherein the adjustment arm is configured so that when the base is attached to the portable computer, the first portion rests against a side of the visual display and the second portion locates in front of the visual display to secure the position of the base with respect to the visual display.

15. The device of claim 10, wherein the antenna is generally parallel with the visual display, and projects away from the visual display when the base is attached thereon.

16. The device of claim 10, wherein the base is securely attached to the visual display in such a manner that a movement of the visual display results in a substantially identical movement of the base.

17. A device comprising:

a portion of a portable computer; and means for remote communication securely attachable to the portion of the portable computer, wherein the means for remote communication is attachable to the portion of the portable computer by means of a base and an adjustable arm, wherein the adjustable arm is slidably moveable along the base, and wherein when the means for remote communication is attached to the portion of the portable computer, the base is attached on the portion of the portable computer and the adjustable arm is extended to the front of the portable computer for providing security of attachment.

18. The device of claim 17, wherein the portable computer is a laptop computer having a separate visual display and CPU base connectable by at least one rotating pin.

19. The device of claim 18, wherein the means for remote communication slides onto the visual display of the laptop.

20. The device of claim 19, wherein the adjustable arm of the means for remote communication further includes a first portion and a second portion that are pivotally connected together, the adjustable arm is configured so that when the base is attached to the portion of portable computer, the first portion rests against a side of the portion and the second portion locates in front of the portion to secure the position of the base with respect to the portion of the portable computer.

21. The device of claim 17, wherein the means for remote communication includes an antenna that is generally parallel with the visual display, and projects away from the visual display when the means for remote communication is attached thereon.

22. The device of claim 17, wherein the means for remote communication includes a layer of resilient material to prevent damage to the portion of the computer when the means for remote communications is attached thereon.

* * * * *